United States Patent [19]

McGill et al.

[11] Patent Number: 4,688,023

[45] Date of Patent: Aug. 18, 1987

[54] CONTAINER HAVING CHILD SAFETY DEVICE AND ALARM

[75] Inventors: Stephen T. McGill; Bette L. McGill, both of La Grange, Tex.

[73] Assignee: Stephen C. Highsmith, La Grange, Tex.

[21] Appl. No.: 766,809

[22] Filed: Aug. 19, 1985

[51] Int. Cl.[4] ..... G08B 13/08

[52] U.S. Cl. ..... 340/545; 200/61.74; 206/1.5; 206/459; 220/346

[58] Field of Search ..... 340/545, 569, 570; 200/61.61, 61.63, 61.71, 61.74, 61.76, 327; 220/DIG. 20, 345–346; 232/36–37; 215/201; 206/828, 528, 534, 536, 539, 1.5, 459

[56] References Cited

U.S. PATENT DOCUMENTS

| | | | |
|---|---|---|---|
| 3,797,006 | 3/1974 | Reininger | 200/61.76 X |
| 3,942,630 | 3/1976 | Phillips | 215/201 X |
| 4,174,034 | 11/1979 | Hoo | 206/1.5 |
| 4,284,204 | 8/1981 | Carey, Jr. | 206/1.5 X |
| 4,462,501 | 7/1984 | Franchi | 206/534 X |

*Primary Examiner*—Glen R. Swann, III
*Assistant Examiner*—Thomas J. Mullen, Jr.
*Attorney, Agent, or Firm*—Glaser, Griggs & Schwartz

[57] ABSTRACT

A container for storing items, such as guns and knives in a secure environment so that such items are not accessible to small children. The container has an open top and a cover member which is slidable along the major axis of the container to selectively open and close the container. A child safety latch is provided to prevent the cover member from being moved substantially from a closed position until the latch is disengaged. An alarm system is also provided so that if the cover member is moved a substantial distance from the closed position, an audible alarm will sound to indicate that the container has been opened. An electric switch is positioned inside the container to enable one to selectively activate and to deactivate the alarm as desired. The container according to the present invention permits an authorized person to gain quick access to the contents to the container when desired, while preventing children from getting access to the contents.

6 Claims, 6 Drawing Figures

CONTAINER HAVING CHILD SAFETY DEVICE AND ALARM

FIELD OF THE INVENTION

The present invention relates generally to security containers and particularly to a container for storing and securing potentially dangerous items, such as guns, knives and the like, whereby such items are not accessible to children but are readily available to adults.

BACKGROUND OF THE INVENTION

Potentially dangerous items, such as guns, knives and the like, are commonly kept at residences. Guns and knives are frequently used for hunting and other outdoor sports and are also used by many homeowners as a means to protect their families and property against intruders. Because burglars and other intruders are more likely to break into an occupied dwelling at night when the occupants are expected to be asleep, it is often necessary to keep a firearm or other weapon near one's bed for quick access should the need arise.

Keeping a gun or knife in one's bedroom for ready access presents a problem when small children are in the house because of the likelihood a child will discover the gun or knife and accidentally inflict injury to himself or others. The need therefore exists in the art for a container in which such guns, knives and the like can be stored to allow quick access by an adult when the need arises and yet prevent such guns and knives from being accessible to small children.

DESCRIPTION OF THE PRIOR ART

Storage containers having alarm systems are known in the art. Such containers typically have an audible alarm which is activated when one opens or attempts to open the container or in some cases when the entire container is moved from its at rest position. Such containers typically include key locks or the like, which allow an authorized person to deactivate the alarm system when access to the contents of the container is desired. A major disadvantage of such containers is that even an authorized person cannot access the contents of the container without setting off the alarm if he loses or temporarily misplaces the key to the lock. Thus, if the homeowner is awakened in the middle of the night by an intruder, the key may not be readily available and even if it is available, it may be difficult and time-consuming to open the lock in the dark without alerting the intruder.

OBJECTS OF THE INVENTION

It is therefore the principal object of the present invention to provide a container in which items can be stored out of the reach of children and which provides a real-time indication that the container has been opened by a child or other unauthorized person.

It is another object of the present invention to provide a container for storing guns, knives and the like out of the reach of small children, while providing quick access thereto by an adult when the need arises.

It is yet another object of the invention to provide a container for storing items in a secure environment, having a system for audibly alerting the custodian of the container in the event that the container is opened by an unauthorized person and for allowing the audible alarm to be deactivated without the necessity of a key or other tool.

SUMMARY OF THE INVENTION

These and other objects are accomplished in accordance with the present invention wherein a container is comprised of a housing having a pair of end walls, a pair of side walls, a bottom member and an open top; a cover member which is movable between a first position at which the container is closed and a second position at which the container is opened to allow access to items stored in the container; latch means for preventing the cover member from being moved more than a first predetermined distance from said first position when said latch means is engaged; activatable alarm means for providing a real-time indication that the container is opened beyond a second predetermined distance from said first position; means responsive to the movement of the cover member beyond a second predetermined distance from said first position for activating the alarm means; and user operable means for selectively enabling the alarm means to be activated by the activating means and for selectively disabling the alarm means from being activated by the activating means.

In one embodiment the housing has a substantially rectangular shape and the cover member is slidably mounted on the housing and is movable along the major axis of the housing between first and second oppositely positioned end walls of the container. The inner surfaces of each of the side walls preferably have respective grooves formed therein, extending substantially along the entire length of the side walls between the first and second end walls, for receiving the respective edges of the cover member.

In another embodiment the latch means is comprised of an arm member which is attached at one end thereof to an inner surface of the first end wall of the container and a stop member which is attached to an inner surface of the cover member. The arm member has a first detent member at the opposite end of the arm member. The first detent member extends upwardly from the arm member and toward the first end wall to form a first engagement surface which faces toward said first end wall. The stop member includes a second detent member, which extends downwardly from the inner surface of the cover member and toward the second end wall to form a second engagement surface which faces toward the second end wall. When the cover member is moved a first predetermined distance from the first position, the second detent member engages the first detent member to inhibit further travel of the cover member.

When the first and second detent members are in engagement, the first engagement surface of the first detent member is in abutting relationship with the corresponding second engagement surface of the second detent member. The respective angles of inclination of the first and second detent members with respect to the arm member and cover member, respectively, are selected so that the first and second engagement surfaces are substantially parallel.

In the preferred embodiment the alarm means is comprised of an electrically activatable audible alarm. The means for activating the alarm is comprised of first switch means which closes an electrical circuit to conduct an electrical signal to activate the alarm when the cover member is moved beyond the second predetermined distance from the first position. The first switch means includes a rotatable lever member and a spring member which biases the lever member to close the switch. When the cover member is within the second predetermined distance from the first position, the cover member is in contact with at least a portion of the lever member and exerts pressure thereon to rotate the lever member against the bias of the spring to open the switch and to deactivate the alarm. The second predetermined distance from the first position is preferably less than the first predetermined distance therefrom so that the alarm is activated before the second detent member engages the first detent member.

The means for selectively enabling and disabling the alarm is preferably comprised of second switch means which is manually operable by a user. The second switch means is in series with the first switch means so that when the second switch means is moved to the open position, the electrical circuit for activating the alarm is broken, thereby disabling the alarm, irrespective of the position of the first switch means. The second switch means is preferably located adjacent to the first end wall to enable the user to deactivate the alarm by moving the cover member a third predetermined distance from the first position and reaching in to turn off the second switch means. The third predetermined distance is preferably less than the second predetermined distance, but is sufficient to enable an adult user to reach in and manually operate the second switch means.

BRIEF DESCRIPTION OF THE DRAWINGS

Still further objects and advantages of the invention will be apparent from the Detailed Description and claims when read in conjunction with the accompanying drawings wherein:

DETAILED DESCRIPTION OF THE PREFERRED EMBODIMENT

In the description which follows, like parts are marked throughout the specification and drawings respectively. The drawings are not necessarily to scale and in some instances proportions may have been exaggerated in order to more clearly depict certain features of the invention.

Figure 1:
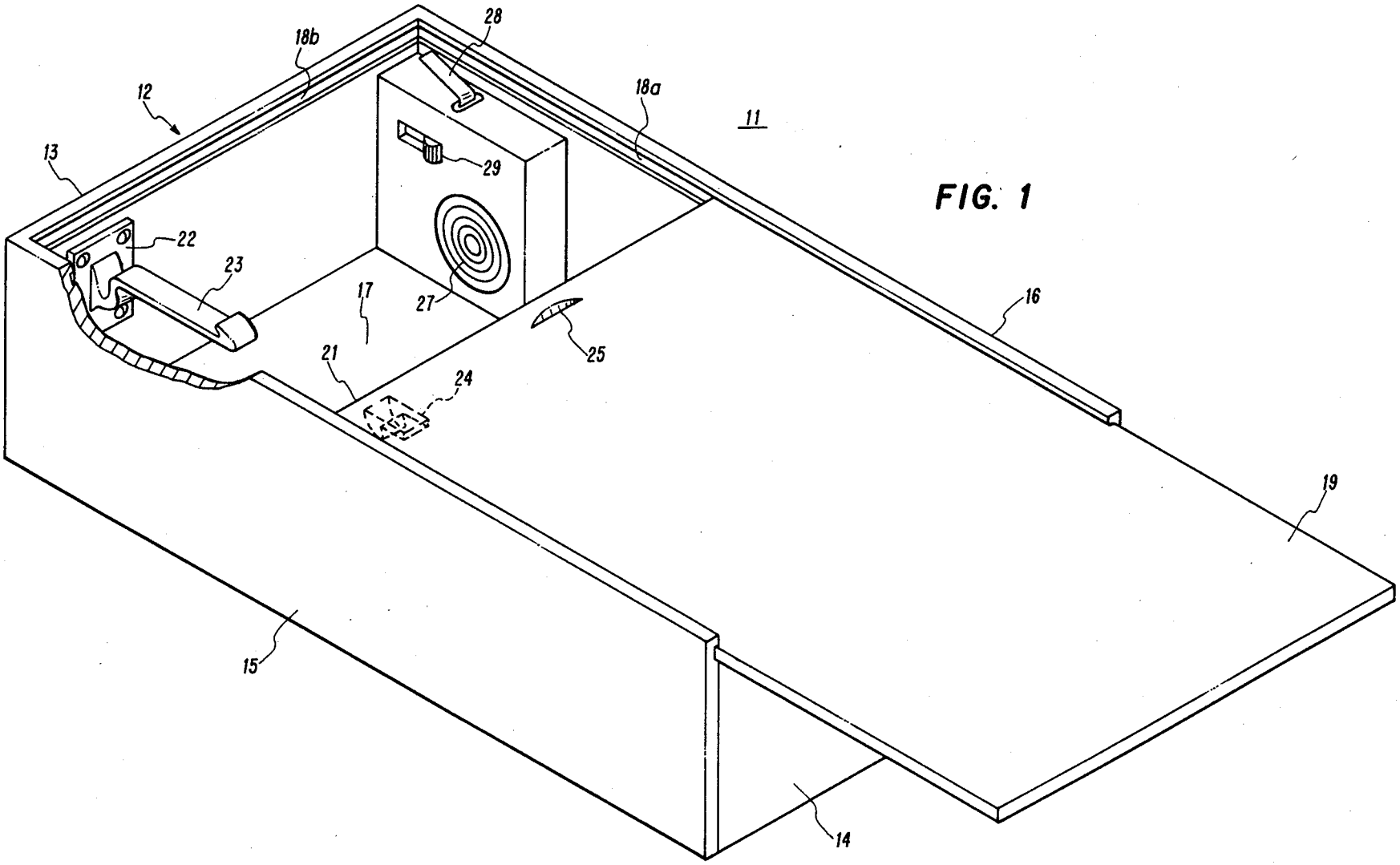
FIG. 1 is a perspective view of the container according to the present invention, showing the container partially open.

Referring now to FIG. 1, a container 11 having a child safety device and alarm according to the present invention is illustrated. Container 11 is comprised of a housing 12 having first and second end walls 13 and 14, respectively; first and second side walls 15 and 16, respectively; and bottom member 17. Slots 18*a* are disposed on the inner surfaces of first and second side walls 15 and 16 and slots 18*b* are disposed on the inner surface of first end wall 13. Slots 18*a* and 18*b* extend substantially along the respective lengths of side walls 15 and 16 and first end wall 13, adjacent to the respective upper edges thereof. Slidably mounted in slots 18*a* of side walls 15 and 16 is a cover member 19, which is movable along the major axis of housing 12 between a first position at which the forward edge 21 of cover member 19 mates with slot 18*b* in first end wall 13 to close off container 11 and a second position at which forward edge 21 of cover member 19 is substantially in registration with the upper edge of second end wall 14 so that container 11 is fully open.

Mounted on the inner surface of first end wall 13 is a first latch member comprised of a base plate 22, which is preferably attached to the inner surface of first end wall 13 by means of four screws, and an arm member 23, which extends outwardly from base plate 22 in the direction of second end wall 14. A second latch member, which is comprised of a catch or stop member 24, is mounted on the underside of cover member 19 for arresting the sliding movement of cover member 19 by engaging arm member 23 after cover member 19 has been moved a predetermined distance from its "fully closed" position, which distance is approximately equal to the length of arm member 23. Cover member 19 further includes a semicircular opening 25 located at approximately midway along forward edge 21 of cover member 19, to facilitate the manual movement of cover member 19.

Disposed inside housing 12, adjacent to the intersection of first end wall 13 and side wall 16 is an alarm system, which is electrically activated by the movement of cover member 19 to provide an audible alarm indicative thereof. The alarm system is mounted within a housing 26 and includes a transducer 27 for transmitting an audible alarm; a first electrical switch, a portion of which is depicted in FIG. 1 as lever arm 28, for automatically activating and deactivating the audible alarm in response to the movement of cover member 19, and a manually operable second electrical switch, a portion of which is depicted by slide member 29, which acts as an "override" switch to selectively enable the alarm to be activated by the first switch or, alternatively, to disable the alarm from being activated, irrespective of the position of the first switch. Slide member is preferably positioned sufficiently close to first end wall 13 to enable the user to open cover member 19 and reach in to operate slide member 29 without activating the alarm. The operation of the alarm system will be described in greater detail with reference to FIGS. 5 and 6 hereinbelow.

Figure 2:
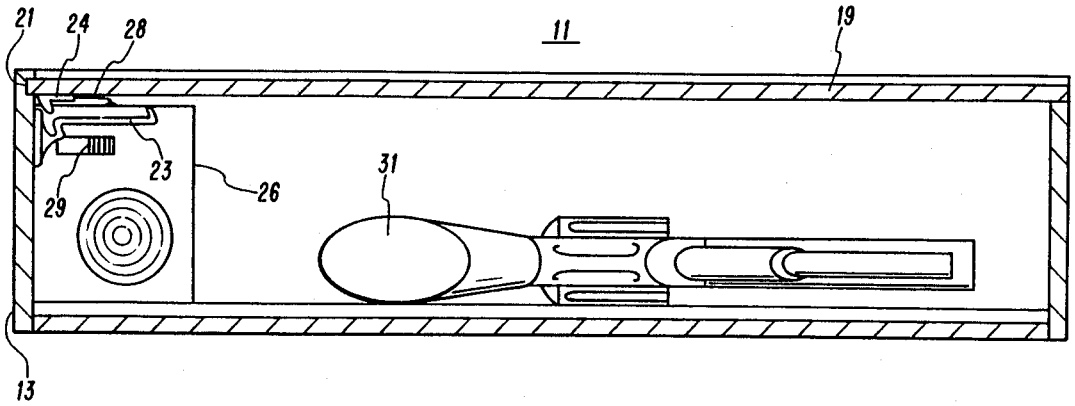
FIG. 2 is a side elevational view of the interior of the container according to the present invention, showing the container closed.
Figure 3:
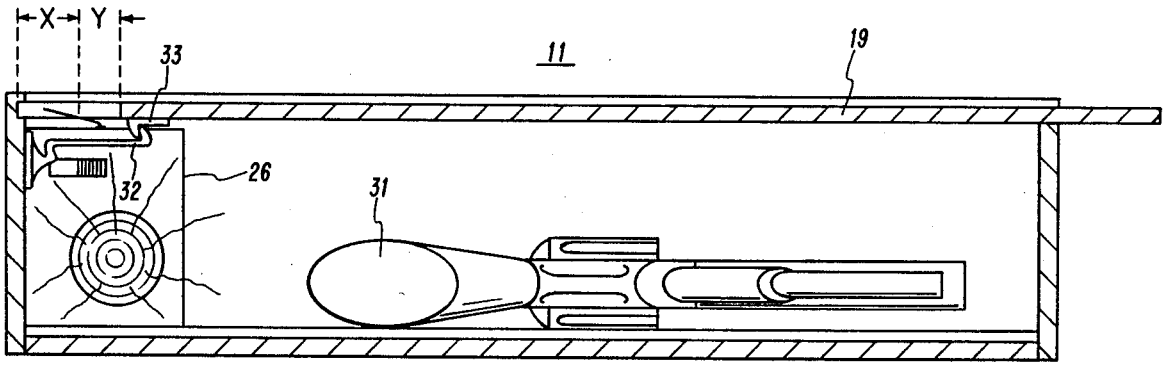
FIG. 3 is a side elevational view of the container according to the present invention, showing the container partially open and an audible alarm activated.

Referring to FIGS. 2 and 3, container 11 is wellsuited for providing a secure storage environment for potentially dangerous items, such as guns and knives, so as to keep such items out of the reach of small children. In FIG. 2 cover member 19 is in the fully closed position with forward edge 21 thereof in engagement with guide slot 18*b* of first end wall 13, to prevent access to the contents of container 11, which is a pistol 31. When cover member 19 is in its fully closed position, stop member 24 is positioned adjacent to the inner surface of end wall 13, and the inner surface of cover member 19 is in contact with lever arm 28. Lever arm 28 is spring biased toward maintaining the first switch in a closed position, so that when lever arm 28 is not in contact with cover member 19, as shown in FIGS. 1 and 3, transducer 27 is activated to produce an audible alarm, assuming slide member 29 is positioned to enable the alarm to be activated. When cover member 19 engages lever arm 28, as shown in FIG. 2, it exerts downward pressure thereon to rotate lever arm 28 against the spring bias and open the switch contacts and deactivate transducer 27.

When cover member 19 is slid along the major axis of container 11, lever arm 28 will be gradually released as cover member 19 is retracted from the closed position. When cover member 19 has been moved a predetermined distance, as indicated by the letter "X" in FIG. 3, from the closed position, the spring bias on lever arm 28 will rotate lever arm 28 away from the top surface of housing 26, as shown in FIG. 3, thereby closing the switch contacts and activating the audible alarm. When cover member 19 is moved an additional distance "Y", a first detent 32 formed on one end of arm member 23 will engage a corresponding second detent 33 extending downwardly from stop member 24 to arrest the sliding movement of cover member 19. To get access to pistol 31 without activating the alarm, the user moves cover member 19 a distance from the closed position less than distance "X" and reaches in to move slide member 29 back toward end wall 13 to disable the alarm. The user then exerts downward pressure on arm member 23 to allow stop member 24 to clear arm member 23 and slide cover member 19 the rest of the way open.

Figure 4:
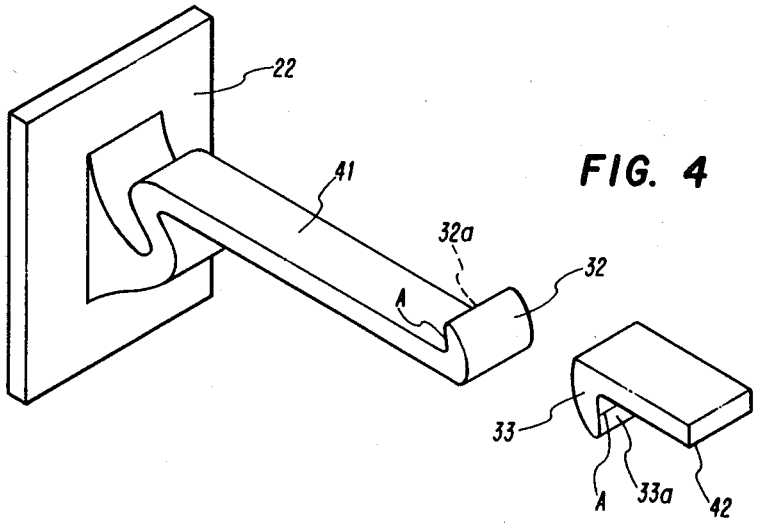
FIG. 4 is a perspective view of a latch device for arresting the movement of the container cover when the latch is engaged, according to the present invention.

As best seen in FIG. 4, first detent 32 slopes upwardly from arm member 23 and toward base member 22 so that detent 32 is sloped at an acute space angle A with respect to major surface 41 of arm member 23. The surface of detent 32 which faces base member 22 forms an engagement surface **32*a* for engaging a corresponding engagement surface on detent 33. Detent 33 extends downwardly from stop member 24 and toward end wall 14 sot hat detent 33 is also sloped at acute space angle A with respect to major surface 42 of stop member 24. The surface of detent 33 facing end wall 14 forms an engagement surface 33*a* for contacting the corresponding engagement surface 32*a* to arrest the sliding movement of cover member 19**.

When detent 32 and 33 are in engagement, respective surfaces **32*a* and 33*a* are in substantially parallel abutting relationship. To disengage 32 and 33, cover member 19 must be moved slightly back toward the closed position so that engagement surfaces 32*a* and 33*a* are no longer in abutting relationship. Arm member 23 is comprised of plastic material which is sufficiently flexible to be bent in the direction of the bottom of container 11 when substantial downward pressure is exerted thereon, to enable detent 33 to clear detent 32 so that cover member 19 can be opened the rest of the way. Arm member 23 is sufficiently rigid to prevent small children from being able to disengage arm member 23 from stop member 24**.

Figure 5:
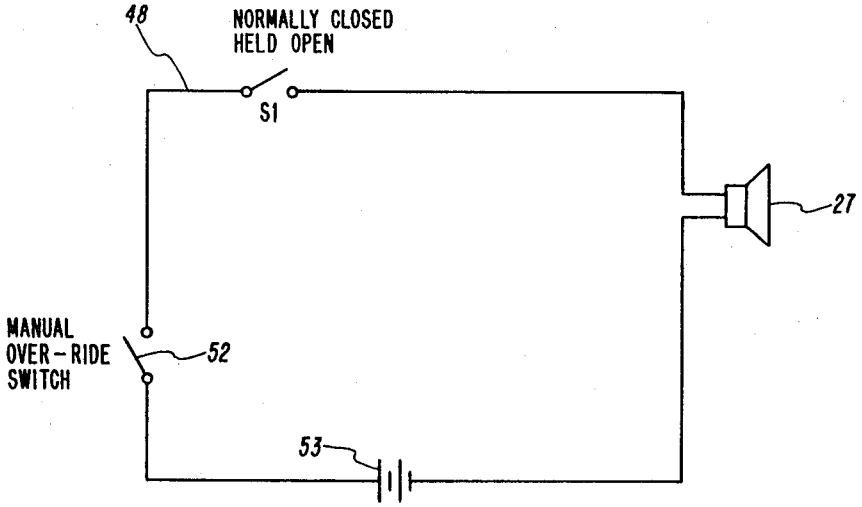
FIG. 5 is an electrical circuit diagram of the alarm activation circuitry, according to the present invention.

Referring to FIG. 5, the electrical circuit for activating the audible alarm is depicted. Spring loaded lever switch 51 is connected by conductor 48 in series with manual override switch 52 for controlling the operation of alarm 27. Alarm 27 is preferably a piezoelectric transducer or other such device for producing an audible alarm in response to an electrical signal. Electrical power is provided by battery power supply 53 located within housing 26. Lever switches 51 and 52 must be closed in order for alarm 27 to be activated. Manual override switch 52 is moved to closed position by manually moving slide member 29 to the position shown in FIGS. 1, 2 and 3. When override switch 52 is in the closed position, alarm 27 is selectively activated and deactivated by spring loaded lever switch 51, which is responsive to the movement of cover member 19, as has been previously described.

Figure 6:
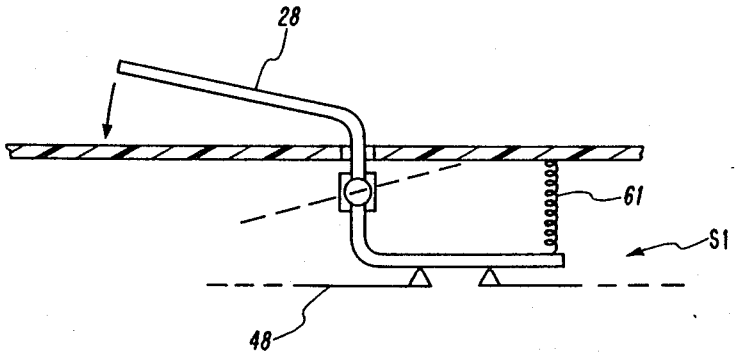
FIG. 6 is an elevational view of an electrical switch for activating and deactivating the alarm in response to the movement of the container cover, according to the present invention.

Referring to FIG. 6, spring loaded lever switch 51 is comprised of a lever arm 28, at least a portion of which extends outwardly from housing 26 for contacting cover member 19 when cover member 19 is closed or within a distance X, as shown in FIG. 3, of the closed position. Spring member 61 biases lever arm 28 toward the closed switch position so that alarm 27 will be activated when lever arm 28 is not in contact with cover member 19. When cover member 19 contacts lever arm 28, it exerts downward pressure on lever arm 28 to rotate lever arm 28 in the direction indicated by the arrows, thereby overcoming the spring bias of spring member 61 and opening the switch to deactivate alarm 27.

The container according to the present invention has the advantage of providing a secure storage medium for items, such as guns and knives, which are dangerous to small children. When the alarm system is enabled, any attempt to open the container sufficiently to get access to the contents thereof will activate an audible alarm, thereby providing a real-time warning to the owner or authorized custodian that the container has been opened. The safety latch mechanism described above will prevent the container cover from being opened beyond a predetermined point, unless until the latch is properly disengaged. Disengagement of the latch is typically beyond the strength and intellectual capability of a small child. When quick access to the contents of the container is desired, a knowledgeable adult opens the cover enough to reach his finger into the container to move the manual override switch to the open position, thereby disabling the alarm. He can then slide the cover to a fully open position without activating the alarm, while briefly exerting downward pressure on the arm member to allow the stop member to clear the arm member as the cover is being slid open. No keys or other instruments are required to open the container and the alarm system may be conveniently disabled when access to the contents of the container is desired.

Various embodiments of the invention have now been described in detail. Since changes in and modifications to the above-described embodiment may be made without departing from the nature, spirit and scope of the invention, the invention is not to be limited to said details, except as set forth in the appended claims.

What is claimed is:

1. A container comprising:

a housing having first and second oppositely positioned end walls, a pair of side walls, a bottom member and an open top forming an enclosure, said housing having a substantially rectangular shape;

a cover member which is movable between a first position at which said enclosure is substantially completely closed to prevent access to items stored therein and a second position at which said enclosure is substantially completely open to allow access to said items, said cover member being slidable along an axis extending between said first and second oppositely positioned end walls of said housing;

latch means for preventing the cover member from being moved beyond a first predetermined nonzero distance from said first position when said latch means is engaged, said latch means including an arm member attached at a first end thereof to an inner surface of the first end wall, said arm member having a first detent member on a second end thereof, opposite from said first end, and a stop member attached to an inner surface of said cover member, said stop member having a second detent member for engaging said first detent member when said cover member is moved said first predetermined distance from said first position, thereby preventing further movement of said cover member until said first and second detent members are disengaged;

activatable alarm means for providing a real-time indication that said cover member is beyond a second predetermined non-zero distance from said first position;

means responsive to the movement of said cover member beyond said second predetermined distance from said first position for activating said alarm means; and, user operable means for selectively enabling said alarm means to be activated by said activating means and for selectively disabling said alarm means from being activated by said activating means.

2. The container according to claim 1 wherein said first detent member slopes upwardly from said second end of said arm member and toward said first end wall, thereby forming a first engagement surface which faces toward said first end wall and said second detent member slopes downwardly from said inner surface of said cover member and toward said second end wall to form a second engagement surface, said second engagement surface being in abutting relationship with said first engagement surface when said cover member is moved said first predetermined distance from said first position.

3. The container according to claim 2 wherein said arm member is comprised of a resilient material so that said arm member is bendable along an axis perpendicular to the bottom member of said container when substantial pressure is exerted on said arm member in the direction of said bottom member, said arm member being disengaged from said stop member by moving said cover member toward said first end wall until said first and second engagement surfaces are no longer in abutting relationship and by exerting pressure on top of said arm member to move said arm member toward the bottom member of said container, thereby allowing said second detent member to clear said first detent member so that said cover member is movable to said second position.

4. The container according to claim 1 wherein said activating means is comprised of first switch means which is responsive to the movement of said cover member beyond said second predetermined distance from said first position for closing an electrical circuit to transmit an electrical signal to activate said alarm means; and, wherein said second predetermined distance is less than said first predetermined distance so that the alarm means is activated by the closure of said first switch means before said latch means is engaged.

5. The container according to claim 1, wherein said activating means is comprised of first switch means which is responsive to the movement of said cover member beyond said second predetermined distance from said first position for closing an electrical circuit to transmit an electrical signal to activate said alarm means;

said means for selectively enabling and disabling said alarm means is comprised of second electrical switch means which is manually operable by a user, said second switch means being in series with said first switch means for enabling said alarm means to be activated when said second switch means is in a closed position and for disabling said alarm means when said second switch means is in an open position, irrespective of the position of said first switch means; and, said second switch means is positioned adjacent to said first end wall so that second switch means is accessible for manual operation thereof when said cover member is moved a third predetermined non-zero distance from said first position, said third predetermined distance being less than said second predetermined distance so that the user is able to disable the alarm means before the alarm means is activated by further movement of the cover member.

6. A safety container for securing an item against unauthorized access comprising a housing having sidewall portions defining a chamber for receiving an item, and a cover slidably coupled to said housing sidewall portions for opening and closing said chamber, releasable latch means attached to said housing and to said cover for limiting movement of said cover relative to said housing in response to engagement of said latch means, an alarm for generating an audible signal, a switch connected to said alarm and movably coupled to said cover for actuating said alarm in response to movement of said cover beyond the limit imposed by said latch means, said latch means including a resilient arm member attached to a housing sidewall portion, said arm member having a latch portion, and said latch means including a stop member attached to said cover, said stop member having a detent portion for engaging said arm latch portion and arresting movement of said cover when said cover is moved a first predetermined non-zero distance from a closed position.

* * * * *

UNITED STATES PATENT AND TRADEMARK OFFICE

CERTIFICATE OF CORRECTION

PATENT NO. : 4,688,023

DATED : August 18, 1987

INVENTOR(S) : Stephen T. McGill and Bette L. McGill

It is certified that error appears in the above-identified patent and that said Letters Patent is hereby corrected as shown below:

In the Abstract, line 16, "to" should be -- of --. (3rd occurr.)

Column 4, line 54, "wellsuited" should be -- well-suited --.

Column 5, line 37, "sot hat" should be -- so that --.

Signed and Sealed this

Twenty-ninth Day of December, 1987

*Attest:*

DONALD J. QUIGG

*Attesting Officer*

*Commissioner of Patents and Trademarks*